US009640170B2

(12) United States Patent
Cipolla et al.

(10) Patent No.: US 9,640,170 B2
(45) Date of Patent: May 2, 2017

(54) ACOUSTICALLY TRANSPARENT AND ACOUSTIC WAVE STEERING MATERIALS FOR ACOUSTIC CLOAKING AND METHODS OF FABRICATION THEREOF

(75) Inventors: Jeffrey Cipolla, Alexandria, VA (US); Nachiket Gokhale, Jersey City, NJ (US); Andrew Norris, Mountainside, NJ (US); Adam Nagy, Bridgewater, NJ (US)

(73) Assignees: THORNTON TOMASETTI, INC., New York, NY (US); RUTGERS, THE STATE UNIVERSITY OF NEW JERSEY, New Brunswick, NJ (US)

( * ) Notice: Subject to any disclaimer, the term of this patent is extended or adjusted under 35 U.S.C. 154(b) by 659 days.

(21) Appl. No.: 13/464,385

(22) Filed: May 4, 2012

(65) Prior Publication Data

US 2014/0126322 A1 May 8, 2014

Related U.S. Application Data

(60) Provisional application No. 61/482,266, filed on May 4, 2011, provisional application No. 61/493,137, filed on Jun. 3, 2011.

(51) Int. Cl.
*G06G 7/48* (2006.01)
*G10K 11/18* (2006.01)

(52) U.S. Cl.
CPC ..... *G10K 11/18* (2013.01); *Y10T 29/49995* (2015.01)

(58) Field of Classification Search
CPC ..... G10K 11/18
USPC ..... 703/6
See application file for complete search history.

(56) References Cited

PUBLICATIONS

Torrent et al.: Anisotropic mass density by two-dimensional acoustic metamaterials; New Journal of Physics 10 (2008) pp. 1-25.*
Norris: Acoustic metafluids; J. Acoust. Soc. Am. 125 _2_, Feb. 2009; pp. 839-849.*
Norris: Acoustic cloaking in 2D and 3D using finite mass; arXiv:0802.0701v1; [physics flu dyn] Feb. 5, 2008; pp. 1-4.*
B. Hassani, et al., "A Review of Homogenization and Topology Optimization II—Analytical and Numerical Solution of Homogenization", Computers and Structures, 69, Elsevier Science Ltd 1998, pp. 719-738.
A. N. Norris, "Acoustic Cloaking Theory", Proceedings of The Royal Society A, published online Apr. 29, 2008, 464, pp. 2411-2434.

* cited by examiner

*Primary Examiner* — Hugh Jones
(74) *Attorney, Agent, or Firm* — Arent Fox LLP

(57) ABSTRACT

Disclosed an acoustically transparent material including an acoustic wave steering material, and methods for fabrication and use thereof. The materials are specially designed structures of homogenous isotropic metals. These structures are constructed to propagate waves according to Pentamode elastic theory. The metamaterial structures are two-dimensional, intended to propagate acoustic waves in the plane in a manner which closely emulates the propagation of waves in water. The acoustically transparent materials described herein have particular utility as acoustic wave steering materials and acoustic cloaks.

9 Claims, 8 Drawing Sheets

ACOUSTICALLY TRANSPARENT AND ACOUSTIC WAVE STEERING MATERIALS FOR ACOUSTIC CLOAKING AND METHODS OF FABRICATION THEREOF

CROSS-REFERENCE TO RELATED APPLICATIONS

This application claims benefit of priority under 35 U.S.C. 119(e) to Provisional Applications No. 61/482,266 filed on May 4, 2011 and No. 61/493,137 filed on Jun. 3, 2011. These provisional applications are incorporated in their entirety by reference herein.

STATEMENT REGARDING FEDERALLY SPONSORED RESEARCH

This invention was made with government support under Grant Nos. N00014-10-C-0260 and N00014-10-1-0399 both awarded by the U.S. Department of Defense. The government has certain rights in the invention.

TECHNICAL FIELD

This disclosure relates generally to the fields of material sciences and acoustic cloaking, and more specifically, to materials which mimic the acoustic behavior of water and methods of use thereof for acoustic cloaking and other applications.

BACKGROUND

Acoustic metamaterials are artificially fabricated materials designed to control, direct, and manipulate sound in the form of sonic, or ultrasonic waves, as these might occur in gases, liquids, and solids. Control of the various forms of sound waves is mostly accomplished through manipulation of the bulk modulus $\beta$, and mass density $\rho$. The density and bulk modulus are analogies of the electromagnetic parameters, permittivity and permeability, respectively, in electromagnetic metamaterials. Related to this is the mechanics of wave propagation in a lattice structure. Also materials have mass and intrinsic degrees of stiffness. Together, these form a dynamic system, and the mechanical (sonic) wave dynamics may be excited by appropriate sonic frequencies (for example pulses at audio frequencies).

Acoustic energy propagation in water depends on two material parameters: the density (approximately 1000 $kg/m^3$) and the bulk modulus (approximately 2.25 Gigapascals) resulting in a fixed speed of sound (approximately 1500 m/s). It is also characterized by its extremely low rigidity, close to zero, which manifests itself in the inability of water to sustain shear waves. The development of a material that could mimic these properties is desirable.

SUMMARY

This disclosure describes an acoustically transparent material including an acoustic wave steering material, and methods for fabrication and use thereof. The materials are specially designed structures of homogenous isotropic metals; these structures are constructed to propagate waves according to Pentamode elastic theory. The metamaterial structures are two-dimensional, intended to propagate acoustic waves in the plane in a manner which closely emulates the propagation of waves in water. The acoustically transparent materials described herein have particular utility as acoustic wave steering materials and acoustic cloaks.

In one example embodiment, a method for fabricating the acoustically transparent material into an acoustic wave steering material comprises machining out of a solid piece of metal a plurality of adjacent regular hexagonal cells having effective elastic properties of water, wherein each regular hexagonal cell includes a plurality of protruding lobes extending inwardly from the vertices of the hexagonal cell. The resulting acoustically transparent two-dimensional material structure has effective elastic properties of water, due to the stiffness and arrangement of the hexagonal cell walls, and mass density, due to the size and mass of the protruding lobes.

In another example embodiment, a method for designing an anisotropic elastic acoustic cloak comprises selecting material microstructures or macrostructures for the acoustic cloak; defining target material properties at a plurality of locations in the cloak, wherein the target material properties include elastic tensor and mass density properties; analytically or experimentally evaluating the selected material microstructures or macrostructures for comparison to target material properties, wherein comparison of the material microstructures or macrostructures to the target material properties is done using an elastic homogenization theory; and refining or altering selected material microstructures or macrostructures on the basis of their deviations from target material properties.

The above simplified summary of example embodiment (s) serves to provide a basic understanding of the invention. This summary is not an extensive overview of all contemplated aspects of the invention, and is intended to neither identify key or critical elements of all embodiments nor delineate the scope of any or all embodiments. Its sole purpose is to present one or more embodiments in a simplified form as a prelude to the more detailed description of the invention that follows. To the accomplishment of the foregoing, the one or more embodiments comprise the features described and particularly pointed out in the claims.

BRIEF DESCRIPTION OF THE DRAWINGS

The accompanying drawings, which are incorporated into and constitute a part of this specification, illustrate one or more example embodiments and, together with the detailed description, serve to explain their principles and implementations.

In the drawings.

DETAILED DESCRIPTION OF EXAMPLE EMBODIMENTS

Example embodiments of the present invention are described herein in the context of material structures, systems, processes, methods and computer programs for fabricating acoustically transparent materials and acoustic wave steering materials used for acoustic cloaking and other applications. Those of ordinary skill in the art will realize that the following description is illustrative only and is not intended to be in any way limiting. Other embodiments will readily suggest themselves to those skilled in the art having the benefit of this disclosure. Reference will now be made in detail to implementations of the example embodiments of the invention as illustrated in the accompanying drawings. The same reference indicators will be used to the extent possible throughout the drawings and the following description to refer to the same or like items.

Metal Water

Metal water is metal that is structurally altered by removing material in a spatially periodic fashion. The remaining metal has the appearance of a metallic foam, but with a very well designed regular structure, so that the overall properties emulate those of water. Metal Water has the same density and longitudinal sound speed as water, and the rigidity is low but not zero. Metal water can be used as a starting material to make a new class of materials that allow acoustic energy in water to be controlled, redirected, and bent so that the sound can travel around objects under water. The idea is to mechanically alter or deform the metal water so that the new metal water has sound speed that varies in direction and in position. The metal water may be used for designing and fabricating acoustic cloaking devices for underwater sound as will be described in greater detail herein.

In one example embodiment, an acoustically transparent material may be a machined or fabricated regular hexagonal network of metal, such as aluminum, or another elastic solid material, (e.g., steel or brass), that has the effective two-dimensional elastic properties (e.g., Young's modulus, Shear Modulus, mass density, etc.) of water, and is referred to as "Metal Water". Therefore this metal metamaterial is almost acoustically indistinguishable from water—when placed in water with the space between the metal sealed, this material allows acoustic waves to pass through undisturbed with minimal reflection or backscatter. The air contained in the space between the metallic foam can be occupied by other material and has effect on the passage of sound as long as the material is not in contact with the metal. This feature provides the foundation for its use as a metamaterial for acoustic cloaking devices.

Figure 1:
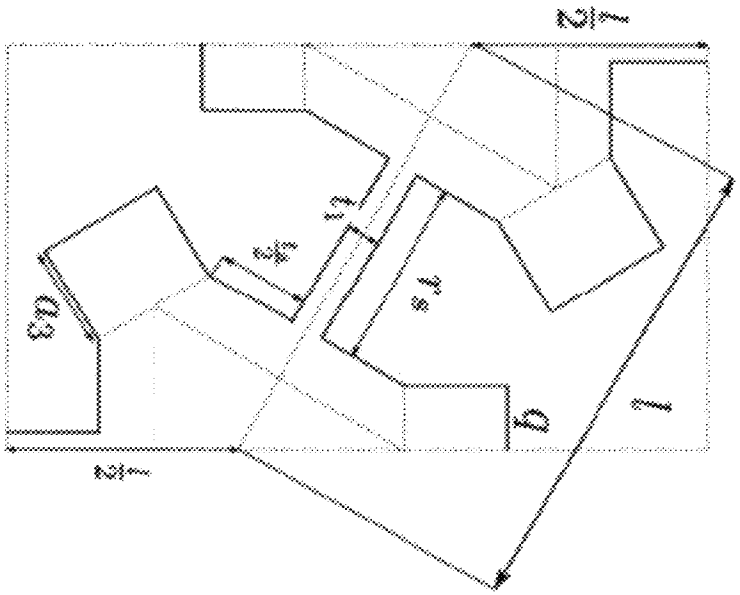
FIG. 1 provides a schematic diagram of acoustically transparent metamaterial and shows the basic element of a unit cell according to one example embodiment of the invention.
Figure 2:
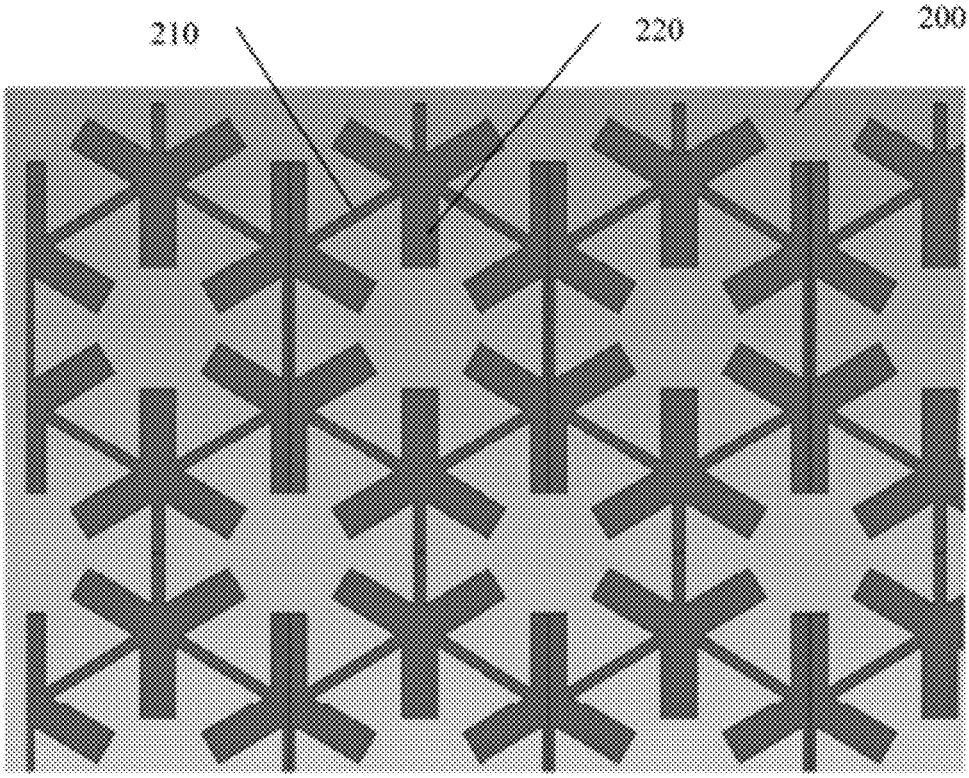
FIG. 2 illustrates a two-dimensional periodic arrangement of acoustically transparent metamaterial according to one example embodiment of the invention.

FIG. 1 shows one example design of an acoustically transparent two-dimensional material structure made out of Aluminum. The structure consists of a unit hexagonal cell formed from the element illustrated in FIG. 1 and arranged periodically. FIG. 2 shows a two-dimensional periodic arrangement 200 of hexagonal cells 210, in which each hexagonal cell 210 includes a plurality of lobes 220 extending inwardly from the vertices of the hexagonal cell. The design for pentamode materials shall consist of similar periodic arrangements of irregular hexagons (as opposed to regular hexagons). The design in FIG. 3 has effective elastic properties (in GPa) shown below:

$$C = \begin{bmatrix} 2.21 & 2.11 & 0 \\ 2.21 & 2.21 & 0 \\ 0 & 0 & 0.052 \end{bmatrix},$$

wherein C is the matrix of elastic stiffnesses [1, 2]

$$C = \begin{pmatrix} C_{11} & C_{12} & C_{16} \\ C_{12} & C_{22} & C_{26} \\ C_{16} & C_{26} & C_{66} \end{pmatrix}$$

These properties are remarkably close to the target properties of water (in two dimensions) in (GPa):

$$C = \begin{bmatrix} 2.25 & 2.25 & 0 \\ 2.25 & 2.25 & 0 \\ 0 & 0 & 0.0 \end{bmatrix}.$$

Figure 3:
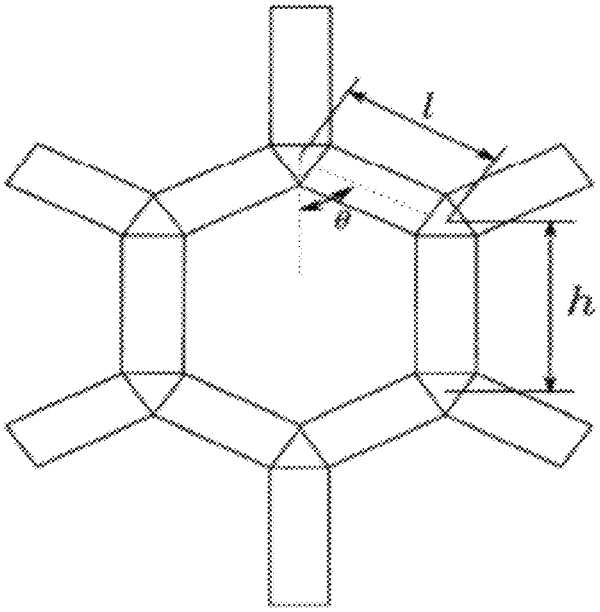
FIG. 3 illustrates schematically a unit cell for the wave steering material according to one embodiment of the invention.

FIG. 3 shows the schematic for a unit cell of wave steering material. The structure consists of a six-sided unit cell with adjustable lengths l and h, and interior angle θ. The elastic stiffness has pentamode form represented by the following equation:

$$C = C_0 \begin{pmatrix} \alpha & 1 & 0 \\ 1 & \frac{1}{\alpha} & 0 \\ 0 & 0 & 0 \end{pmatrix},$$

$$C_0 = \frac{\sin\theta\cos\theta}{2b(M_l + 2M_h\sin^2\theta)},$$

$$\alpha = \frac{l\cos^2\theta}{(h + l\sin\theta)\sin\theta}$$

Figure 4:
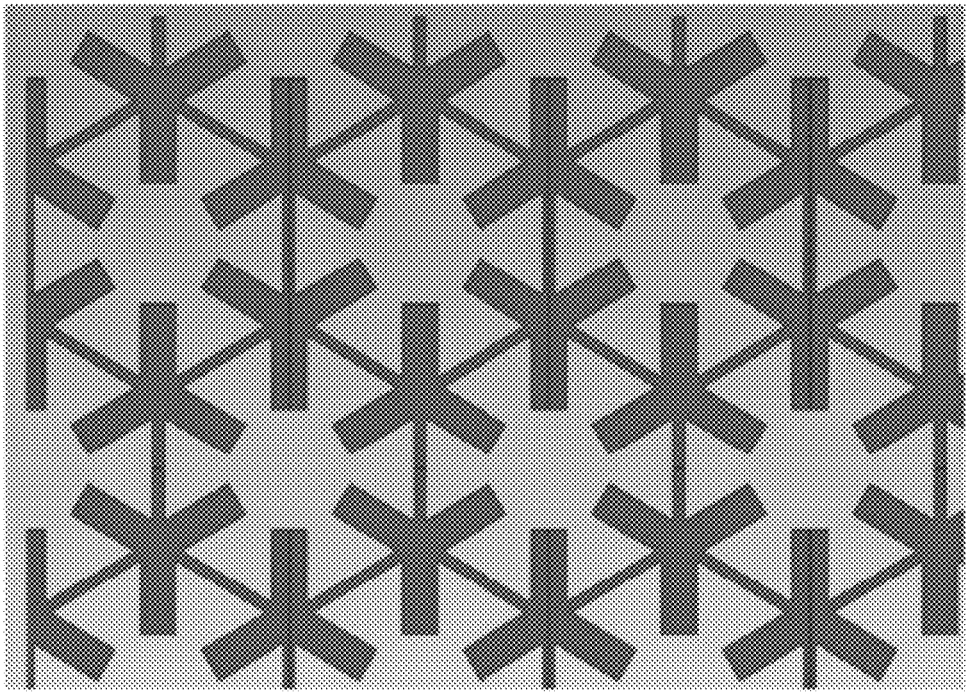
FIG. 4 illustrates a two-dimensional periodic arrangement of an acoustic wave steering metamaterial according to one example embodiment of the invention.
Figure 5:
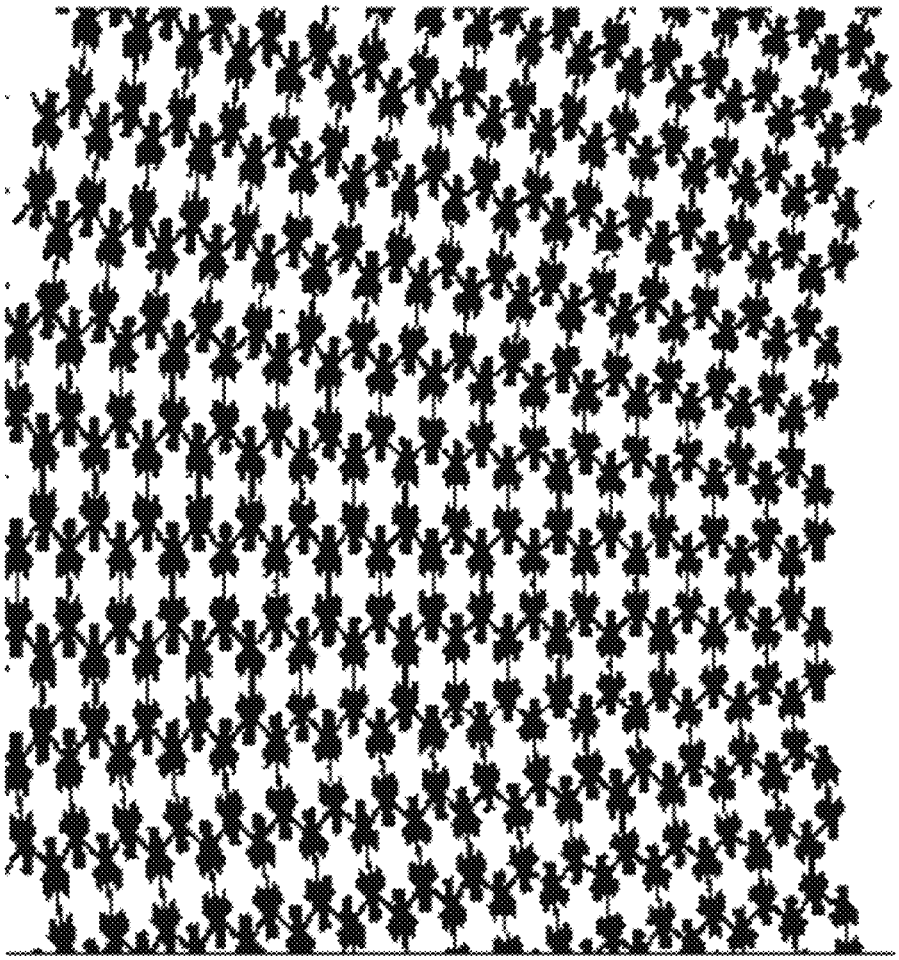
FIG. 5 illustrates a two-dimensional cylindrical arrangement of the acoustic wave steering metamaterial according to one example embodiment of the invention.

The parameter α, which determines the degree of pentamode properties, may be modified by choice of the design parameters l, h and θ. FIG. 4 illustrates a two-dimensional periodic arrangement or one embodiment of the wave steering material. FIG. 5 shows a portion of a cylindrical embodiment of a wave steering material.

Fabrication of metal water into a desired structure involves first preparing a computer aided drawing (CAD) of the part or structure. This is achieved by selecting microstructure of the unit cell, as exemplified in FIG. 1, which finally results in the CAD drawing in FIG. 2. The formulas above provide an initial estimate for the design, from FIG. 3. The intermediate steps require use of computer software, such as the Finite Element Method (FEM), to ensure that the piece depicted by the CAD drawing has the desired properties of the density of water, and the elastic stiffness of water. The example described above for the matrix of elastic stiffness was arrived at using different FEM software packages (e.g., ANSYS, Abaqus) as a check on each other. In the examples described herein, the lengths l and h are equal to one another and the angle θ is 60 degrees (e.g., FIG. 3).

These parameters can be altered to achieve other realizations of the metamaterial suitable for acoustic wave steering. Other design considerations include selecting the two lengths l and h to make the unit cell as small as possible. This depends on the metal to be used. For aluminum, for example, a cell size of less than 1 inch square is feasible using the water-jet process machinery available at the time of filing. Smaller cell sizes may be possible, for example, using other materials (e.g., steel, tin, lead, or brass, etc.) or other manufacturing methods (e.g., powder sintering, conventional milling, laser cutting, extrusion, etc.)

Actual fabrication of the material may be performed, for example, by numerically controlled cutting machines using a CAD drawing to operate the machine. The fabrication can use stock plates of metal, available in a variety of sizes. As an example, a 1 inch by 1 inch by 12 inch block of aluminum is machined using water jet cutting. A water jet cutter, also known as a waterjet, is a tool capable of slicing into metal or other materials using a jet of water at high velocity and pressure. Computer control is essential to achieve the tolerances for the CAD design, which is ported to the machinist electronically. Machining tolerance of less than 0.1 mm is desirable, but larger values are acceptable. Current cutting machines, including waterjets, are capable of using CAD designs from many different software packages, such as MathCAD. Alternative cutting machines can also be used, such as numerically controlled wire-cut electrical discharge machining (EDM).

In summary, fabrication first requires an accurate CAD design suitable to control a computer assisted cutting machine. The initial steps in the development of the CAD drawing start with the equations above to estimate the parameters l and h, which define the size of the unit cell in the regular array. Simultaneous design of the overall density and the elastic stiffness is verified by FEM to ensure accuracy in mimicking the density and elastic stiffness of water. Fabrication is by computer assisted cutting machinery controlled by the CAD design code. The desired tolerances can be achieved by many types of machinery, including, for example, water cutting machines or by wire-cut electrical discharge machinery. It should be also noted that use of metal is merely exemplary and other materials having similar properties may be used to fabricate acoustically transparent metamaterial using principles and method disclosed herein in alternative embodiments. For example, those skilled in the art will realize that fabrication of acoustic transparent materials using silicon or PZT (lead zirconate titanate) may have applications in sensing and design of impedance matched transducers, respectively.

Acoustic Cloak

According to one example embodiment, the above-described metal water may be used to fabricate acoustic cloaks that can be used to conceal objects in water acoustically by enclosing an object, such that sound incident from all directions passes through and around the cloak as though the object was not present. A theory of acoustic cloaking is developed using the transformation method for mapping the cloaked region to a point with vanishing scattering strength. The acoustical parameters in the cloak must be anisotropic: either the mass density or the mechanical stiffness or both. If the stiffness is isotropic, corresponding to a fluid with a single bulk modulus, the inertial density must then be infinite at the inner surface of the cloak. This requires an infinitely massive cloak. Cloaking can also be achieved with finite mass through the use of anisotropic stiffness. The generic class of anisotropic material used herein is the above described pentamode material (PM). If the transformation deformation gradient is symmetric, the PM parameters are then explicit, otherwise its properties depend on a stress-like tensor that satisfies a static equilibrium equation. For a given transformation mapping, the material composition of the cloak is not uniquely defined, but the phase speed and wave velocity of the pseudo-acoustic waves in the cloak are unique.

Fabrication of an acoustic cloaking device follows all of the steps outlined above with respect to metal water, but in addition, includes consideration of the inhomogeneous nature of the structure. Instead of a regular periodic array as shown in FIG. 2 for the metal water, the acoustic cloaking device requires radially varying properties, as depicted in FIG. 5. A section of the general cylindrical embodiment (in FIG. 5) is depicted in FIG. 4, where the design variables have been selected to result in anisotropic wave propagation properties, which manifest themselves as elongated hexagonal cells. Such a design is fabricated by a process similar to above but with different design variables, such as l, h and θ (FIG. 3). The key to the acoustic cloaking device is that the properties vary with the radius in the cylindrical embodiment of FIG. 5 according to specific rules. The nature of the variation in FIG. 5 is not unique but depends on and is defined by what is known as the transformation function. Once the variation has been defined by the choice of the radial transformation function, the fabrication process proceeds as before, in a series of FEM calculations to verify the CAD design has the correct and appropriate properties. Actual fabrication may use the same numerically controlled machine cutting tools.

More specifically, an anisotropic elastic material may be used for acoustic cloaks whose properties are derived through a process in which a virtual volume of the ambient acoustic material is mathematically transformed into an annular volume enclosing a cloaked object. Generally, such elastic materials possess six "modes of deformation": combinations of compression and shear which result in a stress state in the material. Acoustic fluids are a special case of elastic media in which only a purely uniform compression—equal in all directions—is resisted by stress in the material; all shears and other compression modes are not resisted. A pentamode material is a slightly more general case than an acoustic fluid, describing a material which resists one (arbitrary) mode of deformation, and experiences no stress in any other. The following disclosure relates to design of pentamode materials for acoustic cloaking.

Figure 6:
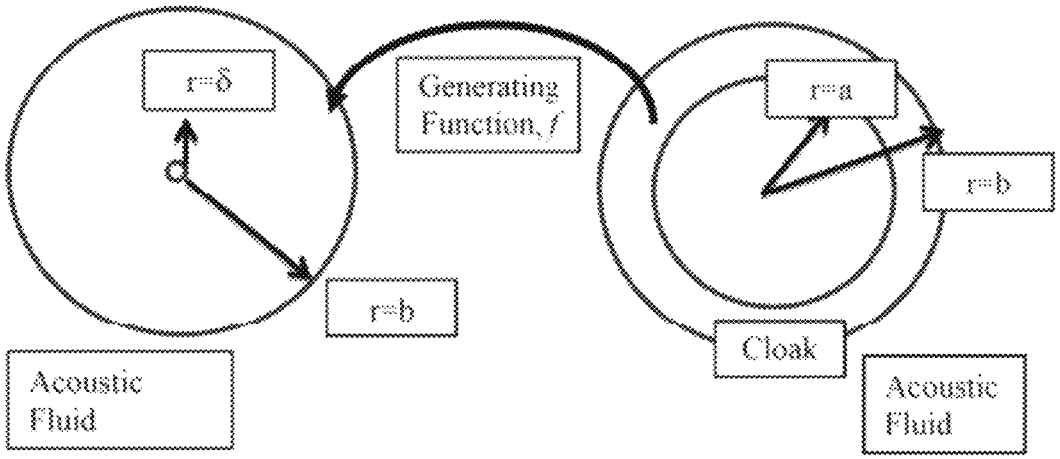
FIG. 6 illustrates a diagram of virtual acoustic volume, acoustic cloak, and generating function according to one example embodiment of the invention.

In one example embodiment, these metamaterial definition processes depend on a specific mathematical function, to be referred to as the "generating function", which is used to describe the transformation between a virtual volume of true acoustic fluid and the volume of the acoustic metamaterial cloak as shown in FIG. 6. This theory of transformation acoustics requires that this generating function be invertible and have strictly positive derivative, but these requirements nevertheless allow an extremely wide range of mathematical functions to be valid generating functions for acoustic cloaks. One example embodiment of a multi-process design methodology for designing an anisotropic elastic acoustic metamaterial is disclosed next.

Process 1: Step A: Defining the elastic tensor and mass density at every location in the cloak through the use of any of the Processes 2 through 10, described below. Step B: evaluating analytically or experimentally selected candidate Material micro- or macrostructures for the cloak for comparison to the material property definitions established in Step A, above. Step C: Performing an analytical comparison of these micro- or macrostructures to the target properties defined in Step A above using, for example, principles of the elastic homogenization theory disclosed in "A Review of Homogenization and Topology Optimization II—Analytical and Numerical Solution of Homogenization", B. Hassani, E. Hinton, *Computers and Structures,* 69, 719-738 (1998), which is incorporated by reference herein. Step D: Refining or otherwise altering candidate micro- or macrostructures on the basis of their deviations from target behavior of Step A, as established in testing at Step B, analytical assessments at Step B or computational homogenization at Step C. In one example embodiment, the steps of Process 1 may be automated computationally.

Process 2. Defining a cylindrical or spherical acoustic metamaterial cloak so that the cloak has isotropic mass density ρ throughout its volume:

Step A: Taking fundamental equations of transformation acoustics and specializing them to the case of pentamode materials as disclosed in "Acoustic Cloaking Theory", A. N. Norris, *Proc. R. Soc. A,* 464, 2411-2434 (2008), which is incorporated by reference herein. These equations define the relationships between the physical dimension parameter d (2 for cylinders and 3 for spheres), the radius of the sphere or cylinder r, the mass density ρ, the elastic property parameters $K_r$ and $K_t$, and the transformation generating function f. (Primes denote differentiation with respect to r).

i. $\rho = \rho_0 f'\left(\frac{f}{r}\right)^{d-1}$, ii. $K_r = \frac{K_0}{f'}\left(\frac{f}{r}\right)^{d-1}$, iii. $K_t = K_0 f'\left(\frac{f}{r}\right)^{d-3}$, iv. $K_r K_t^{d-1} = \left(\frac{\rho}{\rho_0}\right)^{d-2} K_0^d$, v. $f' > 0$ on the interval describing the thickness of the cloak.

Step B: Interpreting the relation 2.A.i as an ordinary differential equation which can be solved for f(r) in the case of constant material density ρ. The materials are constrained to have uniform mass density through the imposition of the following relation:

$$\rho\int r^{d-1}dr=\rho_0\int f^{d-1}df, \quad \text{i.}$$

where ρ is now a constant parameter—the uniform density in the cloak—chosen as part of the process.

Step C: The solution to 2.A under the imposed condition 2.B and the constraint that the generating function f(b)=b results in the following definition for the generating function f:

$$\rho r^d+(\rho_0-\rho)b^d=\rho_0 f^d. \quad \text{i.}$$

Step D: Applying the formula 2.C.i to define the elastic tensor C of the metamaterial at all points in the cloak according to the following relations:

i. $C_{sphere} = \begin{pmatrix} K_r & \sqrt{K_rK_t} & \sqrt{K_rK_t} & 0 & 0 & 0 \\ & K_t & K_t & 0 & 0 & 0 \\ & & K_t & 0 & 0 & 0 \\ & & & 0 & 0 & 0 \\ & (sym) & & & 0 & 0 \\ & & & & & 0 \end{pmatrix}$, or -continued ii. $C_{cylinder} = \begin{pmatrix} K_r & \sqrt{K_rK_t} & \sqrt{K_rK_a} & 0 & 0 & 0 \\ & K_t & \sqrt{K_tK_a} & 0 & 0 & 0 \\ & & K_a & 0 & 0 & 0 \\ & & & 0 & 0 & 0 \\ & (sym) & & & 0 & 0 \\ & & & & & 0 \end{pmatrix}$, where iii. $K_r = K_0 \frac{\rho_0}{\rho}\left(\frac{f}{r}\right)^{2d-2}$, iv. $K_t = K_0 \frac{\rho}{\rho_0}\left(\frac{r}{f}\right)^2$, and v. $K_a$ is an additional elastic stiffness parameter which may be determined by Process 9, described below.

Process 3. Defining a cylindrical or spherical acoustic metamaterial cloak so that the cloak has uniform radial elastic modulus throughout its volume:

Step A: Taking same fundamental equations used in 2.a as the starting point for the process. Step B: Interpreting the relation 2.A.ii as an ordinary differential equation which can be solved for f(r) in the case of constant radial modulus $K_r$. The materials are constrained to have uniform radial modulus through the imposition of the following relation:

$$K_0\int r^{1-d}dr=K_r\int f^{1-d}df, \quad \text{i.}$$

where $K_r$ is now a constant parameter—the uniform radial modulus in the cloak—chosen as part of the process.

Step C: The solutions to 3.b.i are found, as in 2), by enforcing f(b)=b; these solutions depend on the value of d.

i. For $d = 2$, $f(r) = b\left(\frac{r}{b}\right)^{K_0/K_r}$.

ii. For $d = 3$, $f(r) = \frac{rbK_r}{bK_0 + r(K_r - K_0)}$.

Step D: For d=2, the process applies the formula 3.C.i to define the elastic tensor C of the metamaterial at all points in the cloak according to the following relations:

i. $C_{cylinder} = \begin{pmatrix} K_r & \sqrt{K_rK_t} & \sqrt{K_rK_a} & 0 & 0 & 0 \\ & K_t & \sqrt{K_tK_a} & 0 & 0 & 0 \\ & & K_a & 0 & 0 & 0 \\ & & & 0 & 0 & 0 \\ & (sym) & & & 0 & 0 \\ & & & & & 0 \end{pmatrix}$, where ii. $\rho = \rho_0 \frac{K_0}{K_r}\left(\frac{f}{r}\right)^{2d-2}$, iii. $K_t = K_0^2 / K_r$, and iv. $K_a$ is an additional elastic stiffness parameter which may be determined by approach 9), below.

Step E: For d=3, applying the formula 3.c.ii to define the elastic tensor C of the metamaterial at all points in the cloak according to the following relations:

i. $C_{sphere} = \begin{pmatrix} K_r & \sqrt{K_rK_t} & \sqrt{K_rK_t} & 0 & 0 & 0 \\ & K_t & K_t & 0 & 0 & 0 \\ & & K_t & 0 & 0 & 0 \\ & & & 0 & 0 & 0 \\ & (sym) & & & 0 & 0 \\ & & & & & 0 \end{pmatrix}$, where ii. $\rho = \rho_0 \frac{K_0}{K_r}\left(\frac{f}{r}\right)^{2d-2}$, iii. $K_t = K_0^2 / K_r$.

Process 4. Defining a cylindrical or spherical acoustic metamaterial cloak so that the cloak has mass density which varies as a function of the radius of the cloak raised to a power:

Step A: Taking the same fundamental equations used in 2.A as the starting point.

Step B: Interpreting the relation 2.A.i as an ordinary differential equation which can be solved for $f(r)$ in the case of material density $$\rho \equiv \rho_a\left(\frac{r}{a}\right)^{\alpha},$$

where $\rho_a$ is a constant chosen density value and $\alpha$ is an arbitrary exponent. The materials are constrained to have power-law mass density variation through the imposition of the following relation:

$$\rho_a a^{-\alpha}\int r^{\alpha+d-1}dr=\rho_0\int f^{d-1}df. \quad \text{i.}$$

Step C: Finding solutions to 4.B.i, as in Process 2, by enforcing $f(b)=b$; these solutions depend on the value of $\alpha+d$.

i. For $\alpha + d = 0$, $f(r) = \left(Ad\ln\left(\frac{r}{b}\right) + b^d\right)^{1/d}$, ii. For $\alpha + d \neq 0$, $$f(r) = \left(Ad\left(\frac{r^{\alpha+d} - b^{\alpha+d}}{\alpha + d}\right) + b^d\right)^{1/d}, \text{ where}$$

iii. $A = \rho_a / (a^{\alpha}\rho_0)$ in both cases.

Step D: Applying the formula 2.C.i to define the elastic tensor C of the metamaterial at all points in the cloak according to the following relations:

i. $C_{sphere} = \begin{pmatrix} K_r & \sqrt{K_rK_t} & \sqrt{K_rK_t} & 0 & 0 & 0 \\ & K_t & K_t & 0 & 0 & 0 \\ & & K_t & 0 & 0 & 0 \\ & & & 0 & 0 & 0 \\ & (sym) & & & 0 & 0 \\ & & & & & 0 \end{pmatrix}$, or -continued ii. $C_{cylinder} = \begin{pmatrix} K_r & \sqrt{K_rK_t} & \sqrt{K_rK_a} & 0 & 0 & 0 \\ & K_t & \sqrt{K_tK_a} & 0 & 0 & 0 \\ & & K_a & 0 & 0 & 0 \\ & & & 0 & 0 & 0 \\ & (sym) & & & 0 & 0 \\ & & & & & 0 \end{pmatrix}$, where iii. $K_r = K_0 \frac{\rho_0}{\rho}\left(\frac{f}{r}\right)^{2d-2}$, iv. $K_t = K_0 \frac{\rho}{\rho_0}\left(\frac{r}{f}\right)^2$, and v. $K_a$ is an additional elastic stiffness parameter which may be determined by approach Process 9, disclosed below.

Process 5. Defining a cylindrical or spherical acoustic metamaterial cloak so that the cloak has a radial elastic modulus which varies as a function of the radius of the cloak raised to a power:

Step A: Taking the same fundamental equations used in 2.A as the starting point.

Step B: Interpreting the relation 2.A.i as an ordinary differential equation which can be solved for $f(r)$ in the case of radial elastic modulus $$K_r \equiv K_a\left(\frac{r}{a}\right)^{-\alpha},$$

where $K_a$ is a chosen constant value and $\alpha$ is an arbitrary exponent. The materials are constrained to have power-law modulus variation through the imposition of the following relation:

$$K_a a^{-\alpha}\int f^{1-d}df=K_0\int r^{-1+\alpha}dr. \quad \text{i.}$$

Step C: Finding the solutions to 5.B.i, as in Process 2, by enforcing $f(b)=b$; these solutions depend on the value of $\alpha$ and d; there are four distinct cases. Defining $$A = \frac{K_a}{K_0 a^{1-\alpha}},$$

i. For $d = 2$ and $\alpha = 0$, $\left(\frac{f}{b}\right)^A = \frac{r}{b}$, ii. For $d = 2$ and other values of $\alpha$, $$\left(\frac{f}{b}\right)^A = \exp\left(\frac{r^{\alpha} - b^{\alpha}}{\alpha}\right),$$

iii. For $d = 3$ and $\alpha = 0$, $\left(\frac{f}{b}\right) = \left(\frac{A}{A - b\ln\left(\frac{r}{b}\right)}\right)$, iv. For $d = 3$ and other values of $\alpha$, $$\left(\frac{f}{b}\right) = \left(\frac{A\alpha}{b(b^{\alpha} - r^{\alpha}) + A\alpha}\right).$$

Step D: For d=2, applying the formula 5.C.i or 5.C.ii to define the elastic tensor C of the metamaterial at all points in the cloak according to the following relations:

i. $C_{cylinder} = \begin{pmatrix} K_r & \sqrt{K_rK_t} & \sqrt{K_rK_a} & 0 & 0 & 0 \\ & K_t & \sqrt{K_tK_a} & 0 & 0 & 0 \\ & & K_a & 0 & 0 & 0 \\ & & & 0 & 0 & 0 \\ & (sym) & & & 0 & 0 \\ & & & & & 0 \end{pmatrix}$, where i. $\rho = \rho_0 \frac{K_0}{K_r}\left(\frac{f}{r}\right)^{2d-2}$, ii. $K_t = K_0^2 / K_r$, and iii. $K_a$ is an additional elastic stiffness parameter which may be determined by approach Process 9, described below.

Step E: For d=3, applying the formula 5.C.iii or 5.C.iv to define the elastic tensor C of the metamaterial at all points in the cloak according to the following relations:

vi. $C_{sphere} = \begin{pmatrix} K_r & \sqrt{K_rK_t} & \sqrt{K_rK_t} & 0 & 0 & 0 \\ & K_t & K_t & 0 & 0 & 0 \\ & & K_t & 0 & 0 & 0 \\ & & & 0 & 0 & 0 \\ & (sym) & & & 0 & 0 \\ & & & & & 0 \end{pmatrix}$, where vii. $\rho = \rho_0 \frac{K_0}{K_r}\left(\frac{f}{r}\right)^{2d-2}$, viii. $K_t = K_0^2 / K_r$.

Process 6: Defining a cylindrical or spherical acoustic metamaterial cloak so that the anisotropy of the cloak is minimized:

Step A: Defining the measure of anisotropy to be minimized in the acoustic cloak material for each point in the cloak as $$\gamma \equiv \sqrt{\frac{K_r}{K_t}} + \sqrt{\frac{K_t}{K_r}}.$$

Step B: Using the following generating functions f(r) to map the cloak interval [α, b] to the virtual acoustic interval [δ, b]:

i. $f(b^2 - a^2) = (b^2 - a\delta)r - (a - \delta)b^2 \frac{a}{r}$ for $d = 2$, and ii. $f(b^3 - a^3) = (b^3 - a^2\delta)r - (a - \delta)b^3\left(\frac{a}{r}\right)^2$ for $d = 3$.

Step C: Defining the elastic tensor C of the metamaterial at all points in the cloak according to the following relations:

i. $C_{sphere} = \begin{pmatrix} K_r & \sqrt{K_rK_t} & \sqrt{K_rK_a} & 0 & 0 & 0 \\ & K_t & K_t & 0 & 0 & 0 \\ & & K_t & 0 & 0 & 0 \\ & & & 0 & 0 & 0 \\ & (sym) & & & 0 & 0 \\ & & & & & 0 \end{pmatrix}$, (for $d = 3$) or ii. $C_{cylinder} = \begin{pmatrix} K_r & \sqrt{K_rK_t} & \sqrt{K_rK_a} & 0 & 0 & 0 \\ & K_t & \sqrt{K_tK_a} & 0 & 0 & 0 \\ & & K_a & 0 & 0 & 0 \\ & & & 0 & 0 & 0 \\ & (sym) & & & 0 & 0 \\ & & & & & 0 \end{pmatrix}$, (for $d = 2$) where iii. $K_r = \frac{K_0}{f'}\left(\frac{f}{r}\right)^{d-1}$, iv. $K_t = K_0 f'\left(\frac{f}{r}\right)^{d-3}$, and v. $K_a$ is an additional elastic stiffness parameter which may be determined by Process 9, described below.

Step D: Defining the mass density of the cloak material using equation 2.A.i.

Figure 7:
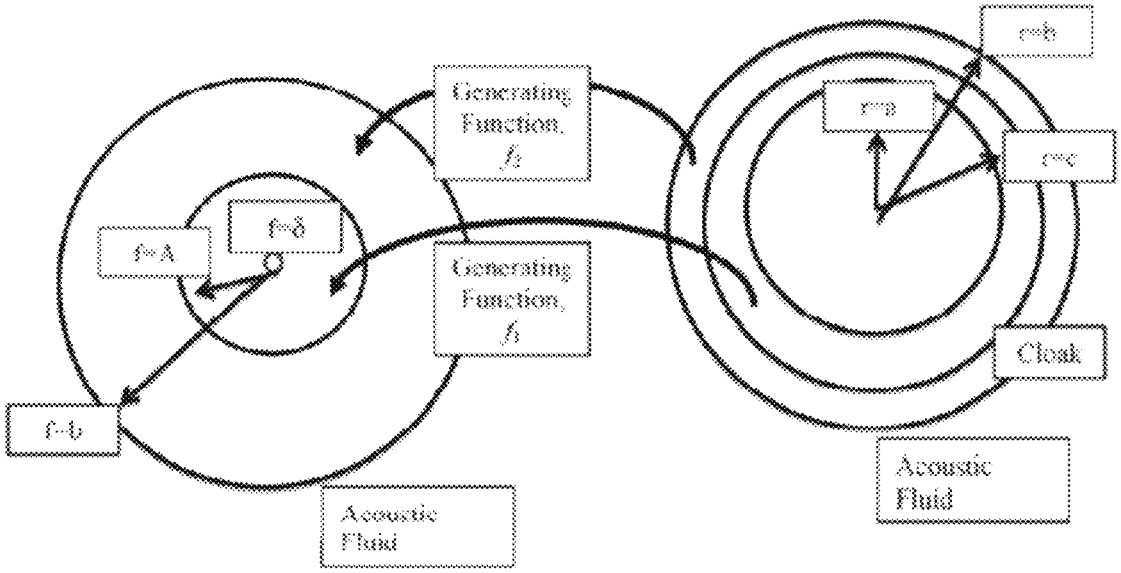
FIG. 7 illustrates a diagram of virtual acoustic volume, acoustic cloak, and generating functions for a two-layer cloak according to one example embodiment of the invention.

Process 7: Defining the mass density and anisotropic stiffness properties of a cylindrical or spherical acoustic metamaterial cloak with multiple layers, in which the density and elastic moduli properties are defined independently for each layer using a separate mapping, and constraining these mappings so that the virtual acoustic volume is continuous: In FIG. 7, a two-layered cloak is shown which is generated from two map generator functions, f1 and f2. These map the intervals r=[a, b] and r=[b, c] to f=[δ, A] and f=[A, B] respectively, as shown in the diagram. It is anticipated that the form of the functions f1 and f2 may be any of the functions detailed above, or other suitable transformation functions. It is anticipated that more than two layers may be employed, each with a generator function.

Process 8: Defining the mass density and anisotropic stiffness properties of a cylindrical or spherical acoustic metamaterial cloak in which the properties follow the generating function numerically or approximately, rather than exactly as prescribed in Processes 2 through 7 above. Processes 2 through 7 in principle require that the material properties in the cloak vary continuously with the radial coordinate. In practice, the cloak relaxes this requirement and may be constructed of many layers of material, each of which has uniform material properties. The uniform properties of each layer are chosen to approximate the continuously varying properties of a cloak defined using Processes 2 through 7.

Process 9: Designing acoustic cloaking materials for cylinders of arbitrary length through the choice of the axial elastic parameters. "Acoustic Cloaking Theory", A. N. Norris, *Proc. R. Soc. A,* 464, 2411-2434 (2008), only describes the radial and tangential material properties of such a cloak; in three dimensions, the properties defining wave propagation parallel to the axis of the cylinder are undefined. Following is one example embodiment of the design of cloaks for three-dimensional cylinders that specifies these properties so that the speed of sound in the ambient medium is matched:

Step A: The speed of sound in the ambient acoustic medium is $$c_0 = \sqrt{\frac{K_0}{\rho_0}}.$$

Step B: Applying any of the Processes 2 through 8 for the d=2 case to define a material mass density, ρ(r) which varies with the radial coordinate.

Step C: The elastic tensor for the d=2 case (See 2.d.ii) has a free parameter, $K_a$. Setting this parameter so that the wave speed in the axial direction is matched to the ambient medium: $K_a(r) \equiv \rho(r) c_0^2$.

Process 10: Designing of acoustic cloaking materials for cylinders of arbitrary length terminated with hemispherical ends through the choice of transformation generating functions which result in matching of wave-bearing properties across the boundary between the cylindrical and hemispherical regions. This is achieved by using the axial moduli defined in Section 9), and by using the same map generating functions $f(r)$ for the cylindrical (d=2) and spherical (d=3) regions.

In various example embodiments, designs for anisotropic elastic acoustic metamaterials that can be used for fabricating acoustic cloaks using the Processes 1 through 10 described above may include but are not limited to composites of polymer, metal, or other materials intended to meet the properties defined by the pentamode theory.

Figure 8:
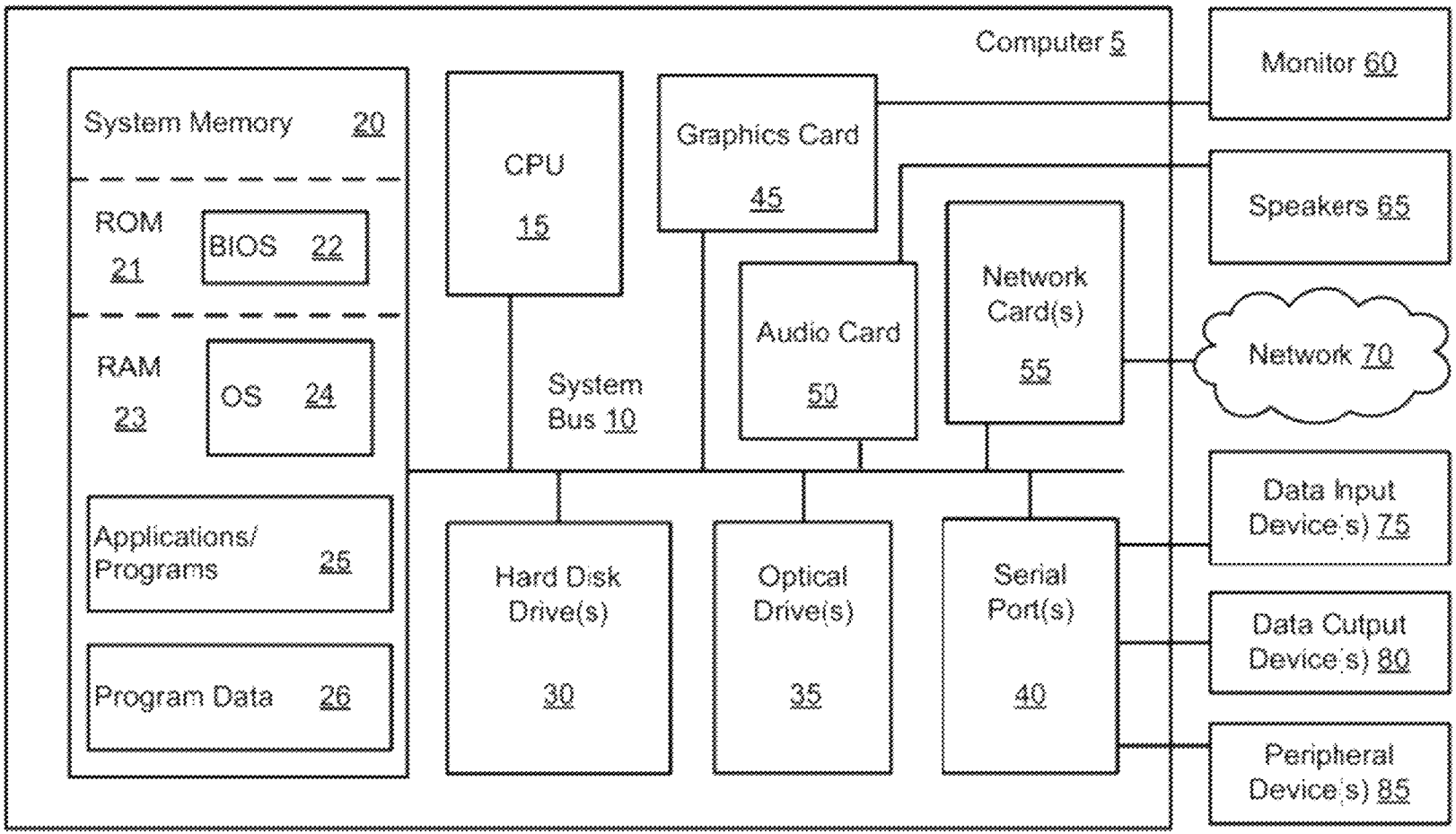
FIG. 8 illustrates a schematic diagram of a computer system for implementing methods for designing anisotropic elastic acoustic cloaking metamaterials disclosed herein.

The design and optimization processes described above may be actualized using software written for general-purpose computers. The software incorporates one or more of the algorithms described above and may be written in any source language (e.g., C++, FORTRAN, etc.) and compiled for a general purpose computer. FIG. 8 illustrates one example embodiment of a computer system 5, such as a personal computer (PC) or a server, suitable for implementing the above-described multi-process design methodology of anisotropic elastic acoustic cloaking metamaterials. As shown, computer system 5 may include one or more processors 15, memory 20, one or more hard disk drive(s) 30, optical drive(s) 35, serial port(s) 40, graphics card 45, audio card 50 and network card(s) 55 connected by system bus 10. System bus 10 may be any of several types of bus structures including a memory bus or memory controller, a peripheral bus and a local bus using any of a variety of known bus architectures. Processor 15 may include one or more Intel® Core 2 Quad 2.33 GHz processors or other type of general purpose microprocessor.

System memory 20 may include a read-only memory (ROM) 21 and random access memory (RAM) 23. Memory 20 may be implemented as in DRAM (dynamic RAM), EPROM, EEPROM, Flash or other type of memory architecture. ROM 21 stores a basic input/output system 22 (BIOS), containing the basic routines that help to transfer information between the components of computer 5, such as during start-up. RAM 23 stores operating system 24 (OS), such as Windows® XP Professional or other type of operating system, that is responsible for management and coordination of processes and allocation and sharing of hardware resources in computer system 5. System memory 20 also stores applications and programs 25, such as MathCAD. System memory 20 also stores various runtime data 26 used by programs 25 as well as various databases of information about CAD designs.

Computer system 5 may further include hard disk drive(s) 30, such as SATA magnetic hard disk drive (HDD), and optical disk drive(s) 35 for reading from or writing to a removable optical disk, such as a CD-ROM, DVD-ROM or other optical media. Drives 30 and 35 and their associated computer-readable media provide non-volatile storage of computer readable instructions, data structures, databases, applications and program modules/subroutines that implement algorithms and methods disclosed herein. Although the exemplary computer system 5 employs magnetic and optical disks, it should be appreciated by those skilled in the art that other types of computer readable media that can store data accessible by a computer system 5, such as magnetic cassettes, flash memory cards, digital video disks, RAMs, ROMs, EPROMs and other types of memory may also be used in alternative embodiments of the computer system.

Computer system 5 further includes a plurality of serial ports 40, such as Universal Serial Bus (USB), for connecting data input device(s) 75, such as keyboard, mouse, touch pad and other. Serial ports 40 may be also be used to connect data output device(s) 80, such as printer, scanner and other, as well as other peripheral device(s) 85, such as external data storage devices and the like. System 5 may also include graphics card 45, such as nVidia® GeForce® GT 240M or other video card, for interfacing with a monitor 60 or other video reproduction device. System 5 may also include an audio card 50 for reproducing sound via internal or external speakers 65. In addition, system 5 may include network card(s) 55, such as Ethernet, WiFi, GSM, Bluetooth or other wired, wireless, or cellular network interface for connecting computer system 5 to network 70, such as the Internet.

In various embodiments, the algorithms and methods described herein may be implemented in hardware, software, firmware, or any combination thereof. If implemented in software, the functions may be stored as one or more instructions or code on a non-transitory computer-readable medium. Computer-readable medium includes both computer storage and communication medium that facilitates transfer of a computer program from one place to another. A storage medium may be any available media that can be accessed by a computer. By way of example, and not limitation, such computer-readable medium can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Also, any connection may be termed a computer-readable medium. For example, if software is transmitted from a website, server, or other remote source using a coaxial cable, fiber optic cable, twisted pair, digital subscriber line (DSL), or wireless technologies such as infrared, radio, and microwave are included in the definition of medium.

In the interest of clarity, not all of the routine features of the embodiments are shown and described herein. It will be appreciated that in the development of any such actual implementation, numerous implementation-specific decisions must be made in order to achieve the developer's specific goals, and that these specific goals will vary from one implementation to another and from one developer to another. It will be appreciated that such a development effort might be complex and time-consuming, but would nevertheless be a routine undertaking of engineering for those of ordinary skill in the art having the benefit of this disclosure.

Furthermore, it is to be understood that the phraseology or terminology used herein is for the purpose of description and not of limitation, such that the terminology or phraseology of the present specification is to be interpreted by the skilled in the art in light of the teachings and guidance presented herein, in combination with the knowledge of the skilled in the relevant art(s). Moreover, it is not intended for any term in the specification or claims to be ascribed an uncommon or special meaning unless explicitly set forth as such.

The various embodiments disclosed herein encompass present and future known equivalents to the known components referred to herein by way of illustration. Moreover, while embodiments and applications have been shown and described, it would be apparent to those skilled in the art having the benefit of this disclosure that many more modifications than mentioned above are possible without departing from the inventive concepts disclosed herein.

The invention claimed is:

1. A computer-implemented method for designing an acoustic cloaking material having anisotropic stiffness and an isotropic mass, comprising the following steps:

selecting one or more material microstructures for a cloak;

defining a variation of one or more target material properties at a plurality of locations in the cloak, wherein the target material properties include anisotropic elastic tensor (C) and isotropic mass density (ρ) properties;

evaluating anisotropic elastic tensor (C) and isotropic mass density (ρ) properties of the selected material microstructures by comparison to the target material anisotropic elastic tensor (C) and isotropic mass density (ρ) properties, wherein the comparison of the material microstructures to the target material properties is performed using an elastic homogenization theory; and refining or altering the selected material microstructures, on the basis of their deviation from the target material anisotropic elastic tensor (C) and isotropic mass density (ρ) properties;

Wherein the cloak includes multiple layers, and wherein the isotropic mass density (ρ) and anisotropic elastic tensor (C) properties for each layer are independently defined using separate mappings, wherein the mappings are constrained so that the material properties at the interface between layers in the volume of the cloak are substantially continuous.

2. The computer-implemented method of claim 1, wherein defining the target material anisotropic elastic tensor (C) and isotropic mass density (ρ) properties for the cloak comprises:

defining a cloak using a specific mathematical transformation which results in a uniform isotropic mass density (ρ) throughout its volume.

3. The computer-implemented method of claim 1, wherein defining the target material anisotropic elastic tensor (C) and isotropic mass density (ρ) properties for the cloak comprises:

defining a cloak using a specific mathematical transformation which results in a distribution of the anisotropic elastic tensor (C) such that the radial-direction elastic modulus is uniform throughout its volume.

4. The computer-implemented method of claim 1, wherein defining the target material anisotropic elastic tensor (C) and isotropic mass density (ρ) properties for the cloak comprises:

defining a cloak using a specific mathematical transformation which results in a mass density (ρ) that varies as a function of a radial coordinate of a point of the cloak raised to an arbitrary power.

5. The computer-implemented method of claim 1, wherein defining the target material anisotropic elastic tensor (C) and isotropic mass density (ρ) properties for the cloak comprises:

defining a cloak using a specific mathematical transformation which results in a distribution of the anisotropic elastic tensor (C) such that a radial elastic modulus is uniform throughout its volume, resulting in a distribution of the anisotropic elastic tensor (C) such that the radial-direction elastic modulus varies as a function of a radial coordinate of a point of the cloak, raised to an arbitrary power.

6. The computer-implemented method of claim 1, wherein defining the target material anisotropic elastic tensor (C) and isotropic mass density (ρ) properties for the cloak comprises:

defining a cloak using a specific mathematical transformation which results in a minimization of the elastic anisotropy of the cloak.

7. The computer-implemented method of claim 1, wherein the materials selected for the acoustic cloak structure comprise one or more of polymers, composites, or metals.

8. The computer-implemented method of claim 1, wherein the structure of the acoustic cloak for d=2 consists of arrangements of regular hexagonal unit cells with equilateral sides, or irregular cells with sides of different lengths or unequal angles.

9. A system for designing an acoustic cloaking material, comprising a processor configured to:

select one or more material microstructures for a cloak;

define a variation of one or more target material properties at a plurality of locations in the cloak, wherein the target material properties include anisotropic elastic tensor (C) and isotropic mass density (ρ) properties;

evaluate anisotropic elastic tensor (C) and isotropic mass density (ρ) properties of the selected material microstructures by comparison to the target material anisotropic elastic tensor (C) and isotropic mass density (ρ) properties, wherein the comparison of the material microstructures to the target material properties is performed using an elastic homogenization theory; and refine or alter the selected material microstructures on the basis of their deviation from the target material anisotropic elastic tensor (C) and isotropic mass density (ρ) properties;

Wherein the cloak includes multiple layers, and wherein the isotropic mass density (ρ) and anisotropic elastic tensor (C) properties for each layer are independently defined using separate mappings, wherein the mappings are constrained so that the material properties at the interface between layers in the volume of the cloak are substantially continuous.

* * * * *